United States Patent [19]

De Labarthe et al.

[11] Patent Number: 4,832,104

[45] Date of Patent: May 23, 1989

[54] DEVICE FOR COVERING OR UNCOVERING A SURFACE BY MEANS OF A COVER

[76] Inventors: Benoit De Labarthe, 122 chemin du Creuzet, 69730 Genay; Roland Verret, 33 rue du Gouvernement, 01600 Trevoux; Pierre Prudhomme, Les Auges, Chasselay - 69380 Lozanne, all of France

[21] Appl. No.: 10,199

[22] PCT Filed: May 22, 1986

[86] PCT No.: PCT/FR86/00172

§ 371 Date: Dec. 30, 1986

§ 102(e) Date: Dec. 30, 1986

[87] PCT Pub. No.: WO86/07110

PCT Pub. Date: Dec. 4, 1986

[30] Foreign Application Priority Data

May 23, 1985 [FR] France ..... 85 08001

[51] Int. Cl.[4] ..... A47H 5/06; E04H 15/18

[52] U.S. Cl. ..... 160/343; 52/63

[58] Field of Search ..... 52/63, 64; 135/102; 74/89.15; 160/343

[56] References Cited

U.S. PATENT DOCUMENTS

| | | | |
|---|---|---|---|
| 2,616,499 | 11/1952 | Eckles | 160/343 |
| 3,208,507 | 9/1965 | Breen | 160/343 |
| 4,280,306 | 7/1981 | Milinic | 52/63 |

FOREIGN PATENT DOCUMENTS

| | | | |
|---|---|---|---|
| 199302 | 6/1908 | Fed. Rep. of Germany | 160/343 |
| 1784559 | 10/1971 | Fed. Rep. of Germany . | |
| 2138011 | 1/1981 | Fed. Rep. of Germany | 74/89.15 |
| 775091 | 12/1934 | France | 160/343 |
| 2398155 | 2/1979 | France . | |
| 2444763 | 8/1980 | France | 52/63 |
| 2497860 | 7/1982 | France . | |
| 372805 | 12/1963 | Switzerland . | |
| 1981 | of 1881 | United Kingdom | 160/343 |

OTHER PUBLICATIONS

Mechanisms, Linkages and Mechanical Controls, Nicholas P. Chironis, McGraw-Hill Book Co., A Publication-1965.

*Primary Examiner*—Michael Safavi

*Attorney, Agent, or Firm*—Parkhurst, Oliff & Berridge

[57] ABSTRACT

A device for covering or uncovering a surface by a cover comprising at least one fixed rigid supporting rod placed close to the surface to be covered, a driving member, a helical screw co-axial to the supporting rod and of which one end is connected to the driving member, a rigid pin connected to the cover to be folded or unfolded and held between the supporting rod and the co-axial helical screw, the rigid pin being designed to slide along the screw.

7 Claims, 5 Drawing Sheets

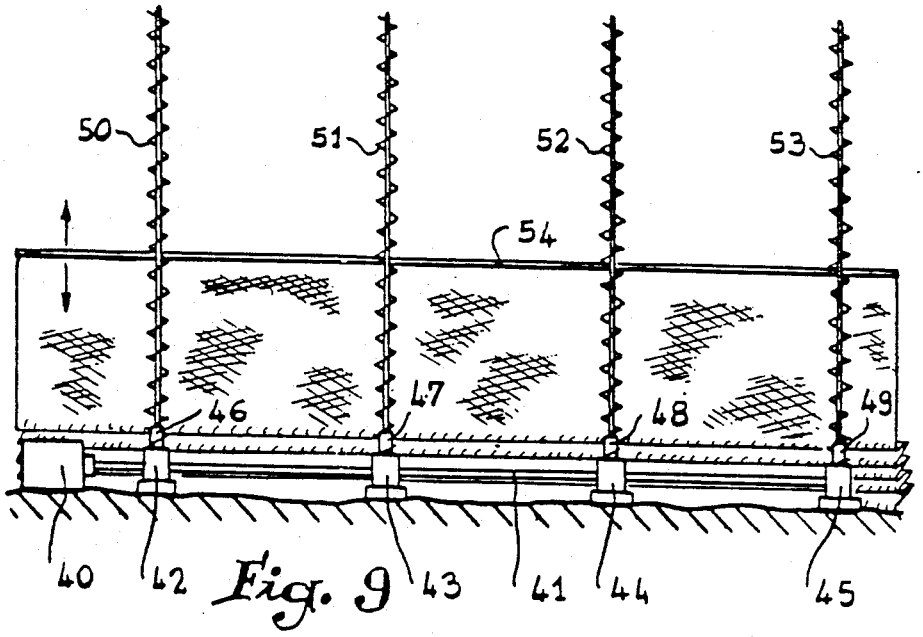
Fig. 9
Fig. 10
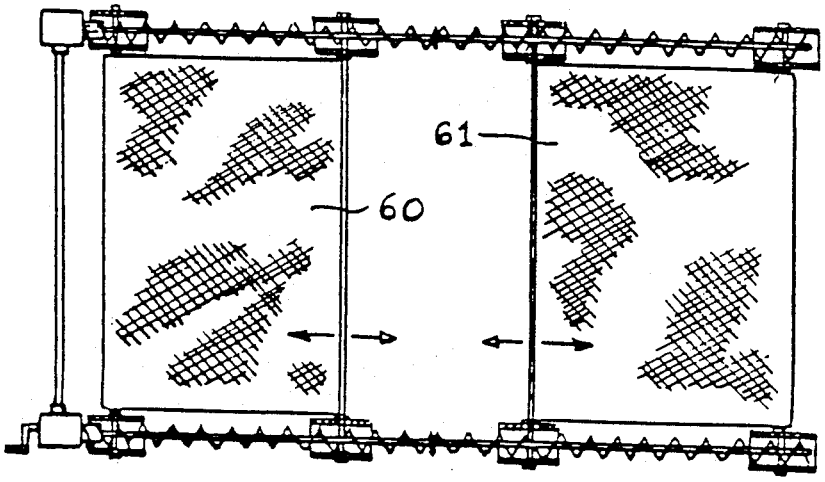

DEVICE FOR COVERING OR UNCOVERING A SURFACE BY MEANS OF A COVER

The invention relates to a device for covering or uncovering a surface, and in particular a large surface, by means of a cover.

To cover large, flat surfaces such as a tennis court, an appropriate cover or tarpaulin is spread by hand on the surface. In general, this operation is done by hand. And because of the large size of the surface and of the weight of the cover, it remains a delicate operation.

For curved surfaces, systems have been proposed which call on the use of cable and pulley systems connected with motors in order to move the cover forward or backward (see for example FR-A-2 398 155). But due to differential displacements between each end of the cover, this system has the regrettable tendency to jam after several movements. Consequently , these systems have not advanced very much so far.

When the cover is rigid, such as for example in the case of a blind, there is also a limitation widthwise.

The invention overcomes these disadvantages. Its object is a device for covering or uncovering a surface, in particular a large surface, by means of a soft or rigid cover, which is easy to produce and ensures a perfect covering over the surface to be covered.

This device for covering or uncovering a surface by means of a cover, is characterized in that it comprises :

at least one fixed rigid supporting rod disposed close to the surface to be covered;

a driving member;

a helical screw, co-axial to said supporting rod, and of which one end is connected to the driving member, so as to be rotatable about said rod;

a rigid pin, fixed to the cover to be spread out (or folded in) and fixed between the supporting rod and the co-axial helical screw, and designed to slide along said screw.

In other words, the invention resides in the combination of a rotary helical screw, co-axial to a fixed supporting rod, covering the surface to be covered, with a rigid pin, joined to the covering sliding along said screw and which is driven in rotation about said supporting rod by means of a driving member. Thus, a perfect sliding of the sleeve is ensured, the sleeve to which is fastened the cover along the screw which latter is supported by the supporting rod placed close to the surface to be covered.

Advantageously, in practice :

the assembly comprises a plurality of parallel supporting rods which are flat if the surface to be covered is flat and which are curved if said surface is curved;

the characteristic rigid pin is mounted in a sleeve co-axial to said helical screw and is disposed according to a chord in a cross-section of said sleeve;

the helical pitch of the screw is between 0.1 and ten times the external diameter of said screw, and the diameter of the torus constituting said screw, made for example from steel, is between 0.05 and 0.5 times that of the external diameter of said screw;

the pitch of the helical screw may be regular or progressive;

according to a first simplified embodiment, the driving member is constituted by a mechanical assembly comprising a crank and bevel gears and an output shaft on which is fixed the end of the helical screw; thus, in the manner of an unfolding blind, by turning the crank, the end of the helical screw is driven in rotation, and as a result, the sleeve moves along said screw, hence along the supporting rod, moving at the same time the end of the cover;

according to an automatizable embodiment, the driving member is constituted by a geared motor, on the output shaft to which is fixed the end of the helical screw;

advantageously, the output shaft of the driving member is fast with a union piece disposed co-axially to the inside of the screw and in which is inserted the end of said screw, said union piece comprising a central bore in which rests the end of the supporting rod idly mounted in said union piece;

the cover is constituted by a single piece,two top ends of which, are each secured to co-axial sleeves sliding on parallel helical screws spaced apart of the length of that side;

the cover is made up of two supple pieces disposed at each one of the ends of the supporting rod, the top ends of each of said two pieces, being each secured to co-axial sleeves sliding on two parallel helical screws, spaced apart of the length of said side, each helical screw provided at one end with a left hand thread and at the other end with a right hand thread the cover is rigid and two of its top ends situated on the same side are each secured to a sleeve sliding on the same helical screw.

The manner in which the invention may be carried out and the advantages derived therefrom will become obvious from the following description of examples of embodient given non-restrictively, with reference to the accompanying drawings.

FIG. 2 shows a detail of the sleeve characteristic of the invention, whereas

FIGS. 9 and 10 illustrate another embodiment of the invention for covering vertical surfaces, such as walls, windows or the like.

Figure 1:
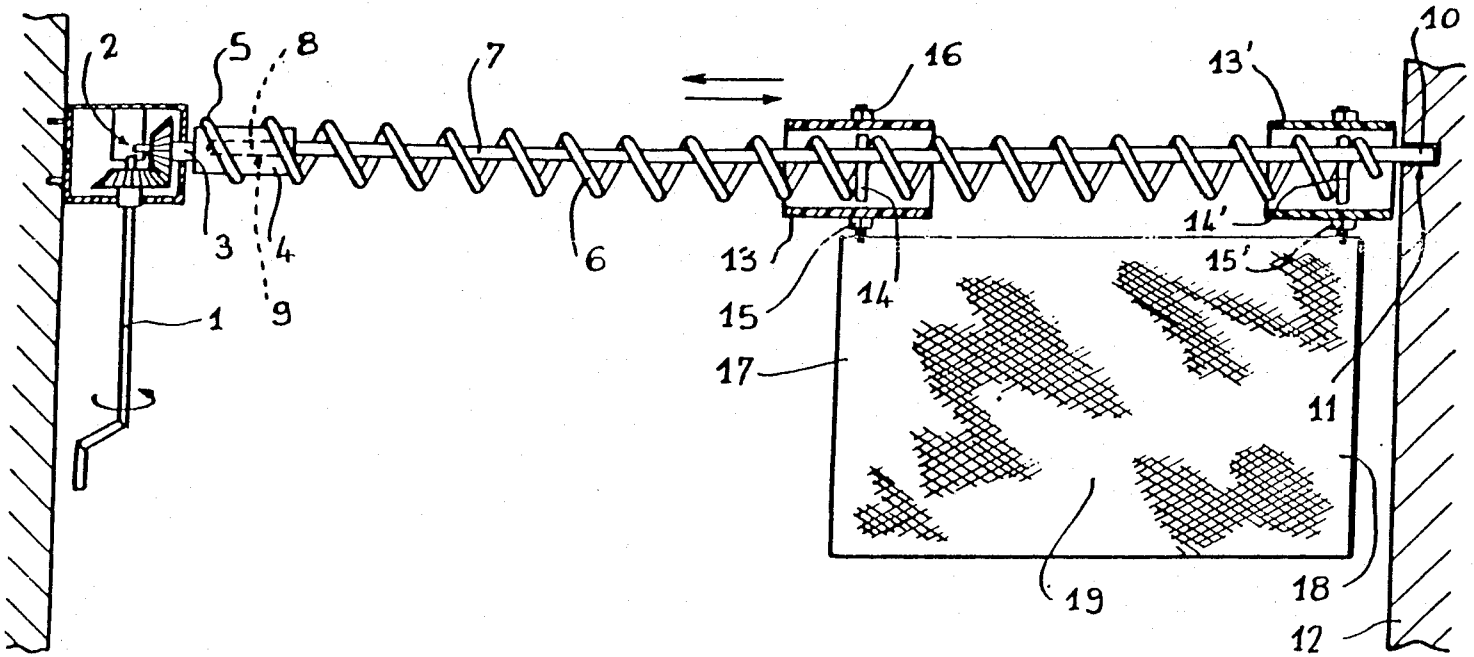
FIG. 1 illustrates a simplified embodiment of the invention, adapted to a rigid cover such as for example a blind.
Figure 2:
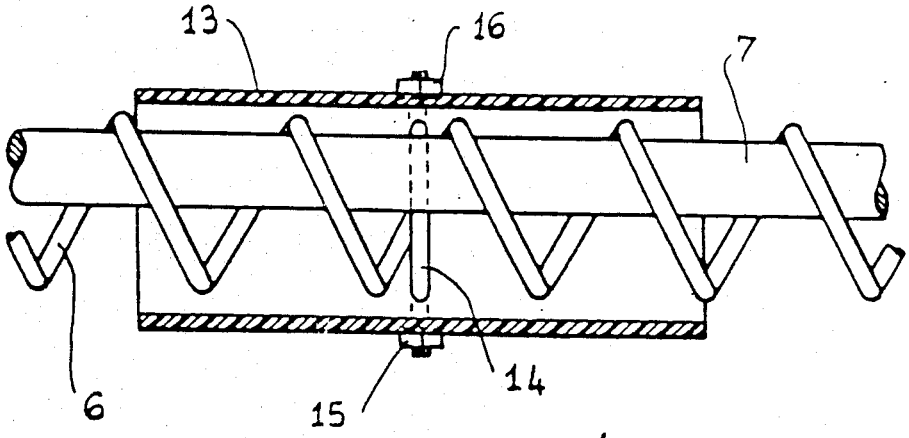
Figure 3:
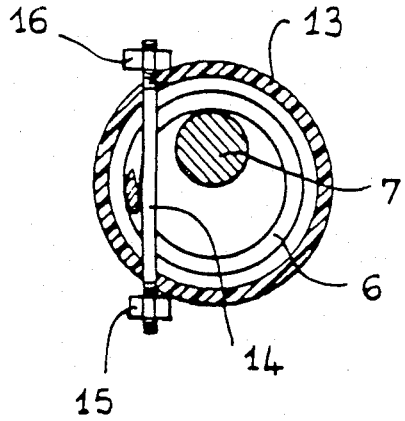
FIG. 3 is a cross-sectional view of said sleeve.

According to a simplified embodiment of the invention shown in FIG. 1, the assembly comprises a crank (1) which actuates a bevel gear (2) to which is secured the output shaft (3) over which is fitted a union piece (4). On said union piece (4) is fixed a helical screw (6), with an end (5) of said helical screw (6) coming in contact with the union piece, said helical screw encircling a rigid rod (7) of which one end (8) is idly mounted in a bore (9) provided to this effect in the union piece (4), while the other end (10) is also idly mounted in an orifice (11) provided to this effect in a wall (12). A co-axial sleeve (13) slides on the characteristic helical screw (6), said sleeve being for example made in a cylindrical tube of PVC of which the internal diameter is slightly more than the external diameter of the screw (6). The sleeve (13) is provided in its center with a rigid pin (14), fixed by two bolts (15,16) offset with respect to the center of the sleeve (13) in the manner of a chord. On the nut (15) and on its homologue (15') are fixed the two sides (17, 18) of a blind to be unfolded, such as for example in front of a window. When the crank (1) is actuated in the direction indicated by the arrow, the union piece (4) is driven in rotation, this causing the screw (6) to turn about the supporting rod (7). In this movement of rotation of the screw (6) about its own axis, the pins (14, 14') slide along the screw (6), thus causing the sleeve (13) and its homologue (13') to move forward. The blind which is, for example, rigid, is thus moved from a first position to a second position and vice-versa as indicated by the arrows.

Figure 4:
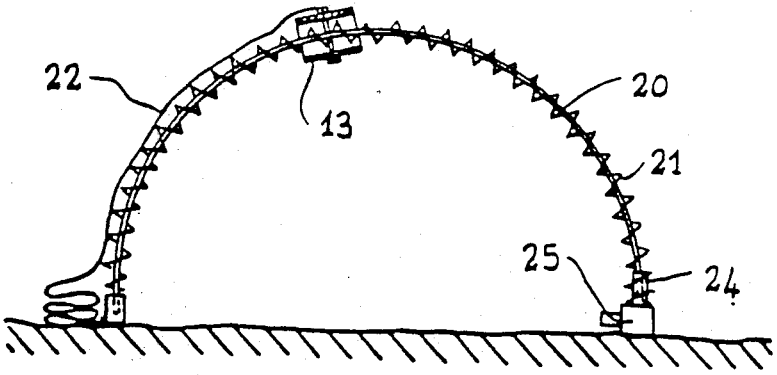
FIG. 4 illustrates a diagrammatical cross-section of a device according to the invention for covering a curved surface, such as a sports hall, or even a green-house.
Figure 5:
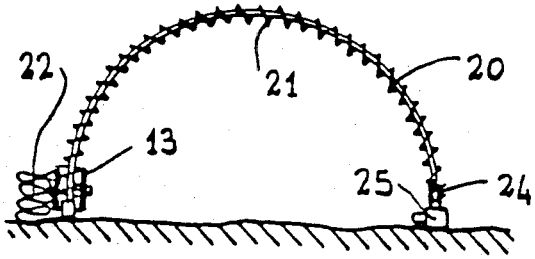
FIGS. 5 and 6 show the same assembly, respectively in open position (FIG. 5) and in completely closed position (FIG. 6).
Figure 6:
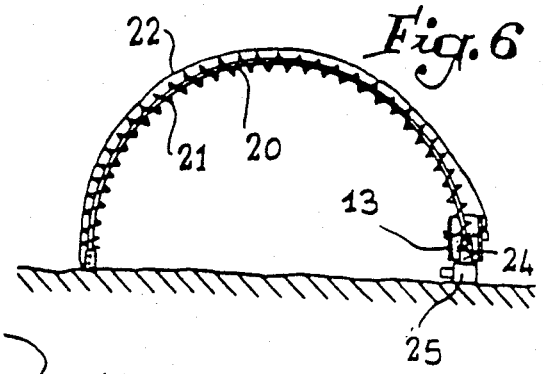

According to the second embodiment illustrated in FIGS. 4, 5 and 6, the surface to be covered is curved. Thus the supporting rod (20) is curved and the helical screw adopts the shape of that rod. Similarly, the cover to be unfolded (22) made up of a single supple part, is fixed to the sleeve (13) and the end of the screw which is fast with the union piece (24) is actuated by an electric motor (25). FIG. 5 shows the completely folded cover (22) whereas in FIG. 4, the same cover only covers half said surface, and finally FIG. 6 shows the whole of said surface.

By way of example, in the embodiment illustrated in FIGS. 4, 5 and 6, a surface of 5 meters width and 1.80 m height, capable of serving as a shelter, was covered. In this particular embodiment, the supporting rod (20) is constituted by a steel bar of 15 mm diameter. The helical screw (21) has an external diameter of 40 mm and a pitch equally of 40 mm; said screw is produced from a cylindrical steel wire of 5 mm. The sliding sleeve (13) is produced from a tube of PVC whose inner diameter is 53 mm and whose length is 20 cm. The rigid characteristic pin (14) has a diameter of 6 mm and is offset by 15 mm.

Figure 7:
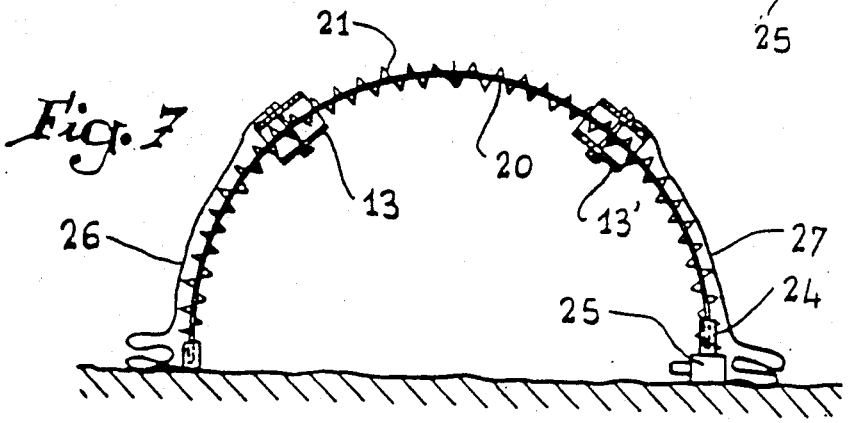
FIG. 7 is another embodiment according to FIG. 4 in which the surface is covered with a cover in two supple parts.

According to the variant illustrated in FIG. 7, the cover is formed of two parts, (26) and (27) respectively disposed on either side of the curved supporting rod (20). The end of each one of these parts (26) and (27) is connected to a sleeve (13) and (13'). In this embodiment, the helical screw (21) is provided at one end with a left hand thread and at the other end with a right hand thread.

Figure 8:
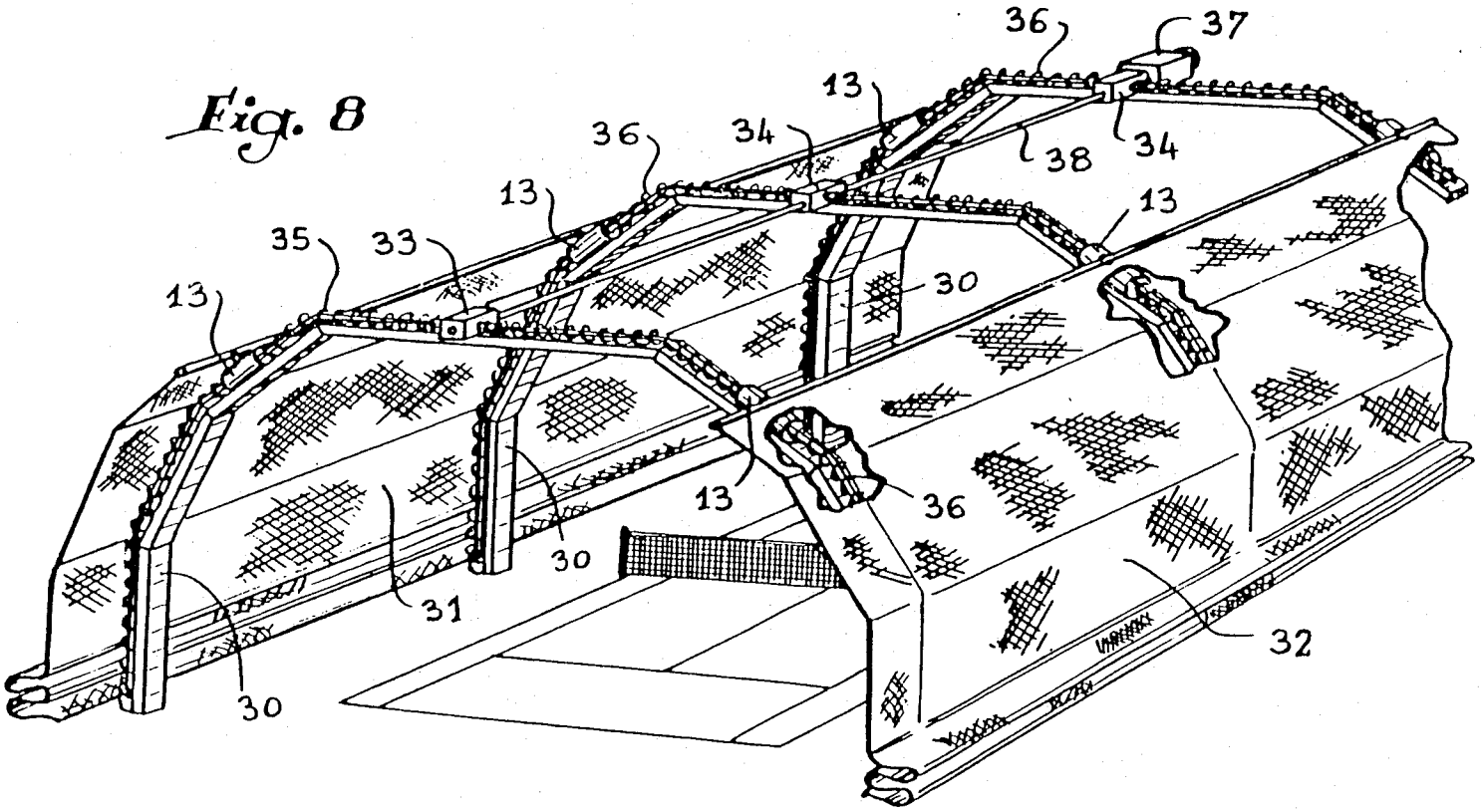
FIG. 8 is a summary perspective of a sports hall comprising a tennis court covered according to the invention.

FIG. 8 shows one more complex embodiment of the invention designed to cover the beams (30) of a sports hall. Here as in FIG. 7, the cover is formed in two parts (31, 32)unfolded on each side in order to join up in the center close to the bevel gears (33,34), the helical screw (35) being provided with a reversed threading arrangement as discussed above. A motor (37) controls shaft and, via the gears (33,34) the characteristic helical scres (35,36).

According to the embodiments shown in FIGS. 9 and 10, the device according to the invention is designed to cover a vertical surface such as, for example, a window or a wall. In the embodiment shown in FIG. 9, a single electric motor, for example a geared motor (40) drives a control shaft (41) which actuates bevel gears (42,43,44,45), which gears in turn drive the union pieces (46,47,48,49) on which are fixed the ends of a plurality of vertical helical springs (50,51,52,53) co-axial to rigid rods, not shown. In this embodiment, the rigid characteristic pin is merely placed between the supporting rod and the helical screw, so that there is no need to use a sleeve.

On the contrary, in the embodiment shown in FIG. 10, the cover is constituted by two supple panels (60,61) which move close together or apart, depending on the case.

The device according to the invention presents many advantages over those known heretofore, since it is easy to produce, easy to work, reliable and since it permits indifferently the covering of surfaces with supple or rigid covers.

Therefore, it can be used advantageously to cover large flat or curved surfaces, such as tennis courts, sports halls, sheds, shelters, swimming-pools, temporary buildings for industrial use, or for storage, or for agricultural use, such as greenhouses, etc.

We claim:

1. A device for covering or uncovering a surface by means of a cover, comprising;
   - at least one fixed rigid supporting rod, placed close to said surface;
   - a driving member;
   - a helical screw, co-axial to said supporting rod, one end of which is connected to the driving member, said helical screw freely surrounding said supporting rod;
   - sliding means connected to the cover for sliding along said screw, said sliding means comprising a cylindrical hollow sleeve co-axial to the supporting rod and to the helical screw, the inner diameter of said sleeve being larger than the external diameter of the helical screw ; and
   - said sleeve comprising a rigid pin, offset with respect to a center of the sleeve and located along a chord in a radially planar cross-section of said sleeve, said pin being inserted between the supporting rod and the helical co-axial screw, said pin being designed to slide along said screw.

2. The device according to claim 1, wherein the driving member
   - is constituted by a mechanical assembly comprising a crank, a bevel gear , and an output shaft on which is fixed the end of the helical screw.

3. The device according to claim 1, wherein the driving member is a geared motor on an output shaft to which is fixed the end of the helical screw.

4. The device according to claim 2, wherein the output shaft of the driving member is securely connected to a union piece placed co-axially to and within the screw and in which is fitted the end of said screw, said union piece comprising a central bore in which rests an end of the supporting rod.

5. The device according to claim 1, wherein the cover is formed in one supple piece of which two top ends disposed on one side are each fixed to a co-axial sleeve sliding on the helical screw, said co-axial sleeves spaced axially apart along the length of the helical screw.

6. The device according to claim 1, wherein the cover is formed of two supple pieces disposed at opposite ends of the supporting rod, of which top ends of the two supple pieces
   - are each fixed to a co-axial sleeve sliding on
   - the helical screw, the co-axial sleeves spaced axially apart along the length of said helical screw, the helical screw provided at one end with a left hand thread and at another end with a right hand thread.

7. The device according to claim 1, wherein the helical pitch of the screw is between 0.1 times and ten times the outer diameter of said screw and the diameter of the torus constituting said screw is between 0.05 times and 0.5 times the outer diameter of said screw.

* * * * *